US008337246B2

(12) United States Patent
Zhang

(10) Patent No.: US 8,337,246 B2
(45) Date of Patent: Dec. 25, 2012

(54) HIGH SPEED STACKED MODULAR JACK HAVING SHIELDING PLATE

(75) Inventor: Zhi-Cheng Zhang, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/160,566

(22) Filed: Jun. 15, 2011

(65) Prior Publication Data

US 2011/0306242 A1 Dec. 15, 2011

(30) Foreign Application Priority Data

Jun. 15, 2010 (CN) ..... 2010 2 0226109

(51) Int. Cl.
*H01R 13/648* (2006.01)

(52) U.S. Cl. ..... 439/607.01

(58) Field of Classification Search ..... 439/607.01, 439/607.23, 676, 541.5, 540.1
See application file for complete search history.

(56) References Cited

U.S. PATENT DOCUMENTS 5,190,462 A 3/1993 Lauchner et al.
5,639,267 A 6/1997 Loudermilk
6,238,245 B1 5/2001 Stokoe
6,511,348 B1 1/2003 Wojtacki et al.
6,623,307 B2 9/2003 Korsunsky et al.
6,655,988 B1 12/2003 Simmons et al.
6,659,807 B1 12/2003 Zheng et al.
7,168,985 B1 * 1/2007 Zhang et al. ..... 439/607.23
7,670,172 B2 3/2010 Zhang et al.
7,674,136 B2 3/2010 Steinke et al.
2005/0282432 A1 * 12/2005 Murr et al. ..... 439/540.1
2006/0166550 A1 * 7/2006 Murr et al. ..... 439/540.1
2011/0306240 A1 * 12/2011 Chow et al. ..... 439/607.01
2011/0306241 A1 * 12/2011 Zhang ..... 439/607.01
2011/0312212 A1 * 12/2011 Machado et al. ..... 439/488

* cited by examiner

*Primary Examiner* — Chandrika Prasad
(74) *Attorney, Agent, or Firm* — Ming Chieh Chang; Wei Te Chung

(57) ABSTRACT

A modular jack (100) comprising a housing (200) defining an upper port and a lower port vertically stacked under the upper port, and a contact module (400) assembled to the housing. The contact modules each comprises a first vertical PCB (46) and a second vertical PCB (47) extending along a front-to-rear direction, a vertical shield plate (50) disposed between the first vertical PCB and the second vertical PCB, a mating module, and a horizontal shield plate (418) disposed between the upper contact module and the lower contact module. The horizontal shield plate is disposed below the upper row of ports and above the lower row of ports and connecting the vertical shield plate.

20 Claims, 14 Drawing Sheets

HIGH SPEED STACKED MODULAR JACK HAVING SHIELDING PLATE

This application is one of three patent applications having a same title of "HIGH SPEED MODULAR JACK" and being filed on a same date.

BACKGROUND OF THE INVENTION

1. Field of the Invention

The present invention relates to modular jack, and particularly, to a high speed modular jack having stacked mating ports.

2. Description of Related Art

U.S. Pat. No. 6,655,988, issued to Simmons et al. on Dec. 2, 2003, discloses a stacked jack modular jack assembly having a multi-port housing. The assembly includes the housing, a plurality of jack modules, a plurality of LEDs, and a plurality of LED modules. The jack module 10 includes an outer insulating housing holding a jack subassembly. The jack subassembly comprises an upper jack portion, an intermediate shield, and a lower jack portion, a lower housing portion, two vertical component boards, and a vertical shield member disposed between the two vertical component boards.

U.S. Pat. No. 6,659,807, issued to Zheng et al. on Dec. 9, 2003, discloses another multiport modular jack. The modular jack has an insulating housing and a plurality of jack subassemblies. Each jack subassembly has a base member, a first and second horizontal printed circuit boards (PCB), a pair of insert portions mounted on corresponding PCBs, and a plurality of terminals insert molded in the insert portions. One of the insert portions has a plurality of first positioning posts and first mounting holes, the other insert portion has a plurality of second positioning posts and mounting holes second stably engaging with the first mounting holes and the first positioning posts.

U.S. Pat. No. 6,511,348, issued to Wojtacki et al. on Jan. 28, 2003, discloses another multiport modular jack. The modular jack comprises an outer housing and a plurality of modular jack subassemblies. The modular jack subassemblies are comprised of an elongate beam support having a plurality of modular jack contacts on both sides thereof. The contacts extend into printed circuit board contacts and extend to and beyond the side edges of the elongate beam support, leaving the space above and below the printed circuit board contacts and the beam support free, to accommodate signal conditioning component. Two printed circuit board modules are mounted orthogonally to the side edges of the beam support and include signal conditioning components. A vertical shield plate is interposed between two adjacent subassemblies.

Such multi-port connectors are used for networks and operated at high rates of one gigabyte and higher so that excellent conditioning of the signals to be transferred is required. Shielding is therefore normally necessary in order for example to provide a so-called Common Mode Rejection (CMR) and to guarantee a specified electromagnetic compatibility (EMC) and/or resistance to electromagnetic disturbance. For the purpose of conditioning the signals it is therefore further necessary to incorporate within the arrangement corresponding components such as particularly magnet coils but also capacitive components in order to correspondingly condition the signals.

An object of the invention consequently consists of providing a new and substantially improved modular jack connector structure with respect to the prior art and particularly for use in the case of Ethernet networks so as to provide a modular jack connector with complete shielding between any two adjacent ports and required signals conditioning.

SUMMARY OF THE INVENTION

In accordance with the invention, a modular jack connector is therefore provided adapted to be mounted onto a horizontal mother PCB. The modular jack comprises a housing and a plurality of contact modules assembled to the housing. The housing defining an upper row of ports and a lower row of ports vertically stacked in columns. The plurality of contact modules each comprises a first vertical PCB and a second vertical PCB extending along a front-to-rear direction, a vertical shield plate disposed between the first vertical PCB and the second vertical PCB, a mating module having an upper set of mating contacts electrically connecting one port in the upper row to the first vertical PCB and a lower set of mating contacts electrically connecting a lower port stacked in the same column to the second vertical PCB, and a horizontal shield plate disposed between the upper contact module and the lower contact module. The horizontal shield plate is disposed below the upper row of ports and above the lower row of ports and connecting the vertical shield plate.

In accordance with the invention, another modular jack connector is therefore provided to be mounted onto a horizontal mother PCB. The modular jack comprises a housing defining an upper port and a lower port vertically stacked under the upper port; and a contact module assembled to the housing. The housing defines an upper row of ports and a lower row of ports vertically stacked in columns. The plurality of contact modules each comprises a bracket having a vertical shield plate extending along a front-to-rear direction, a first plastic body and a second plastic body on opposite sides of the vertical shield plate, a first vertical PCB and a second vertical PCB being arranged on opposite sides of the bracket and parallel to the vertical shield plate, and a mating module having an upper set of mating contacts electrically connecting one port in the upper row to the first vertical PCB and a lower set of mating contacts electrically connecting a lower port stacked in the same column to the second vertical PCB.

Other objects, advantages and novel features of the invention will become more apparent from the following detailed description of a preferred embodiment when taken in conjunction with the accompanying drawings.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
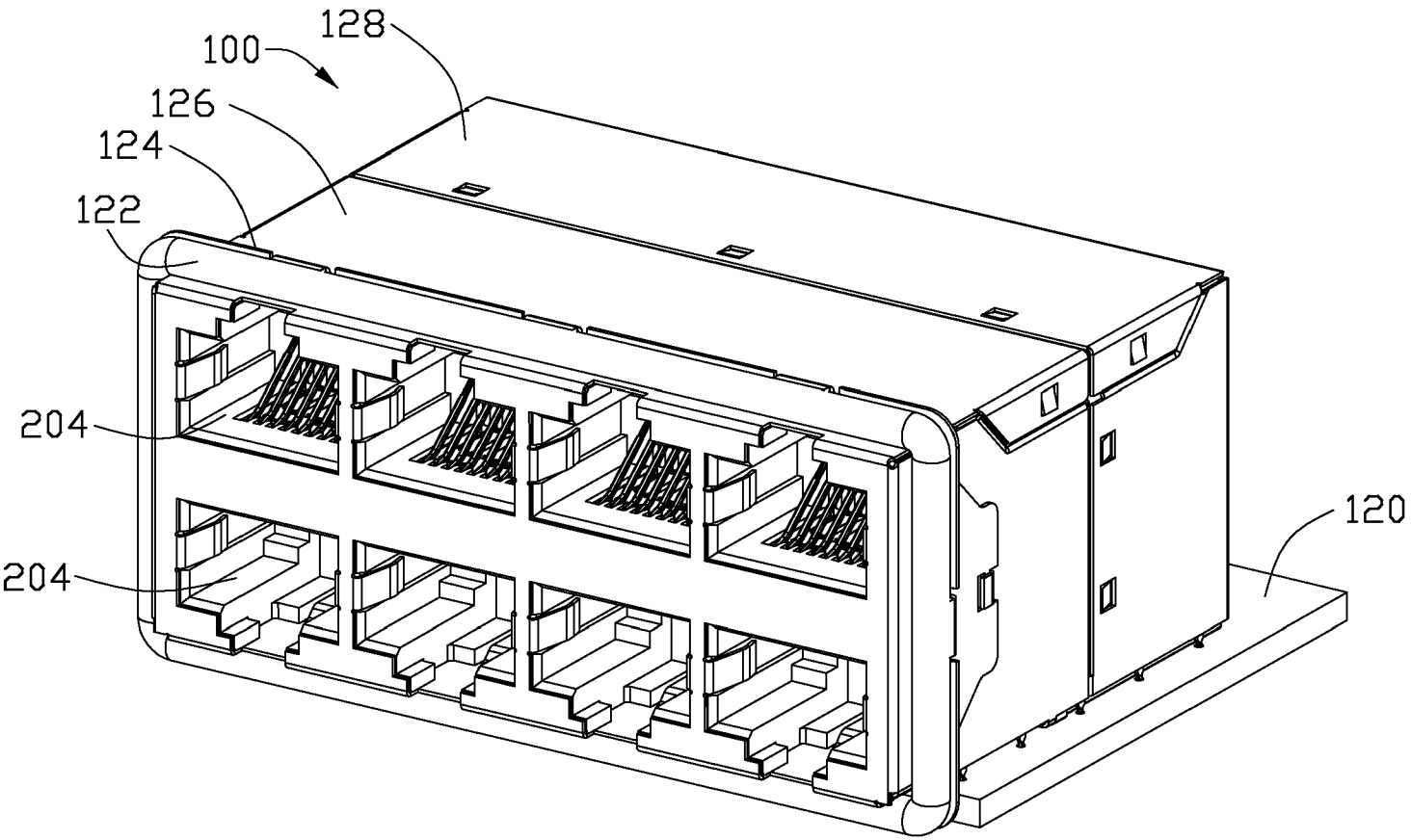
FIG. 1 is a perspective view of a stacked modular jack according to the present invention, mounted on a horizontal mother PCB.

Reference will now be made to the drawing figures to describe the present invention in detail.

Referring to FIG. 1, a perspective view of a 2×4-port modular jack 100 is shown. The modular jack 100 is used to be mounted on a horizontal printed circuit board 120 (horizontal mother PCB). The modular jack 100 has an upper row of ports 204 and a lower row of ports 204, each of which is used to receive a modular plug (not shown) with a high speed of 10 Gigbit/second. The modular jack 100 is covered with an outer metal shell including a front outer shell 126 and a rear outer shell 128. The front outer shell 126 is equipped with a bracket board 124 and a gasket 122 of a conductive rubber supported by the bracket board 124. The gasket 122 surrounds the front end of modular jack 100. When the modular jack 100 is mounted into a panel (not shown), the gasket 122 is pressed between the bracket board 124 and the panel.

Figure 2:
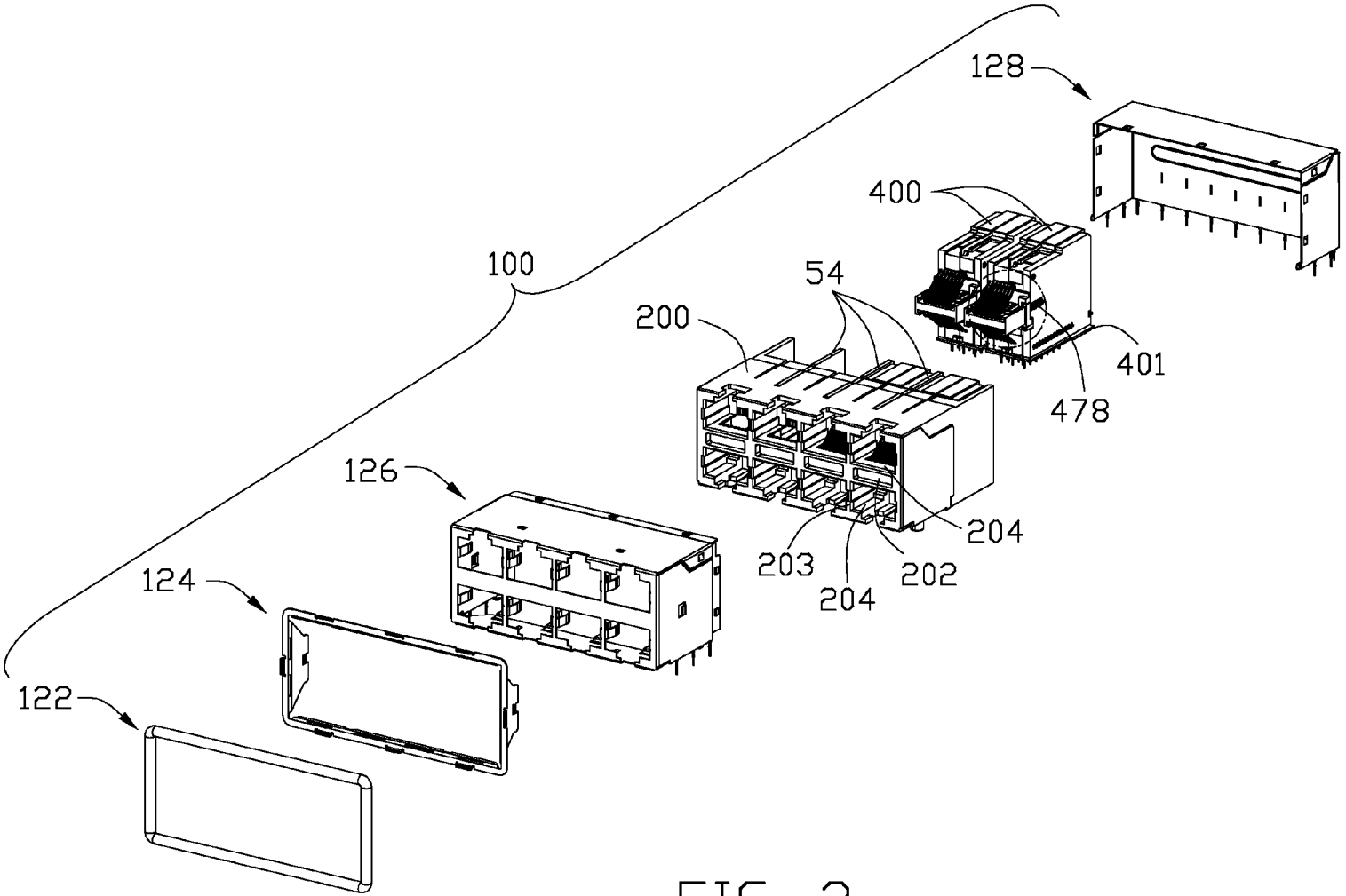
FIG. 2 is a partly exploded view of the modular jack shown in FIG. 1.
Figure 3:
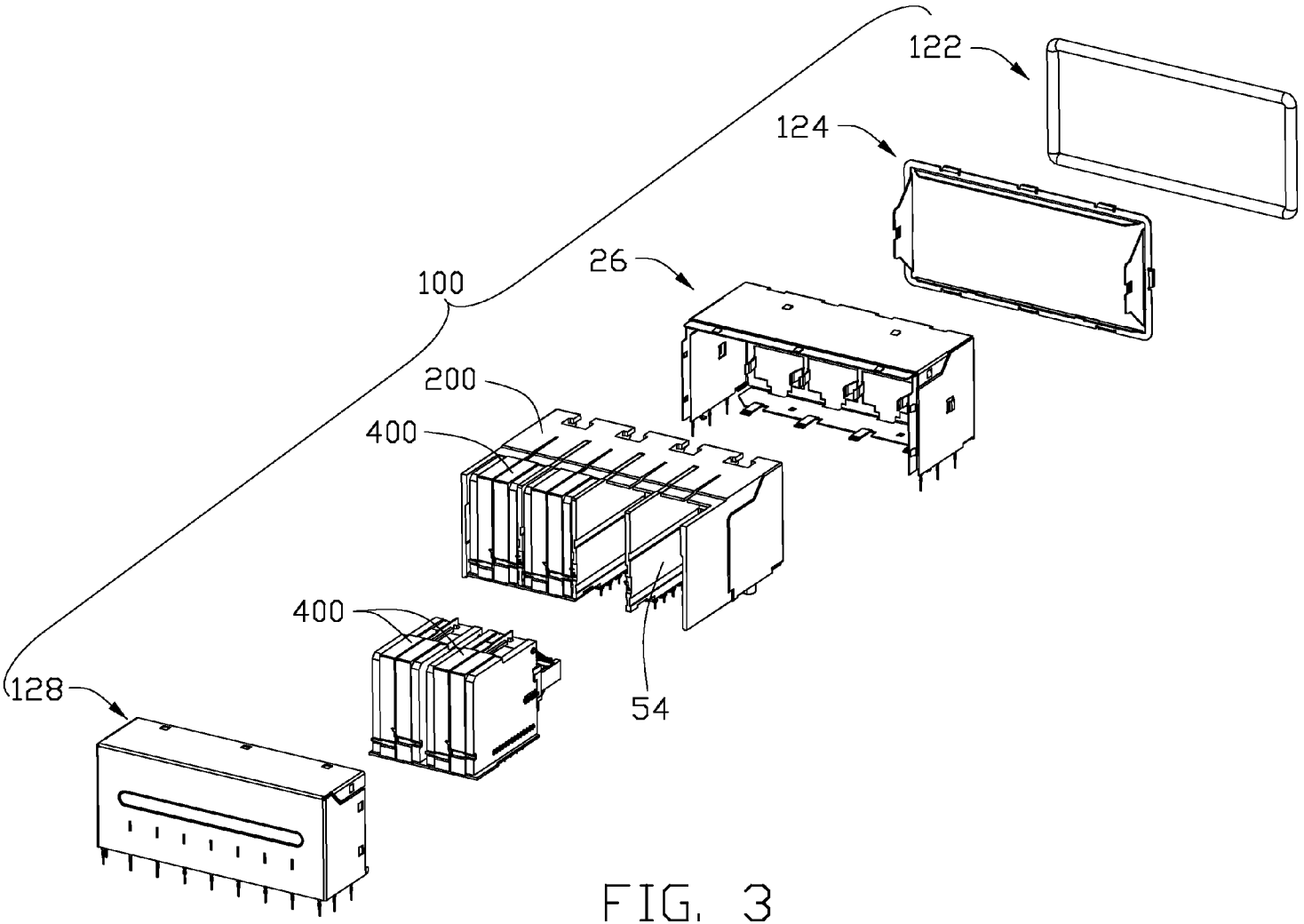
FIG. 3 is another partly exploded view of the modular jack shown in FIG. 1.
Figure 4:
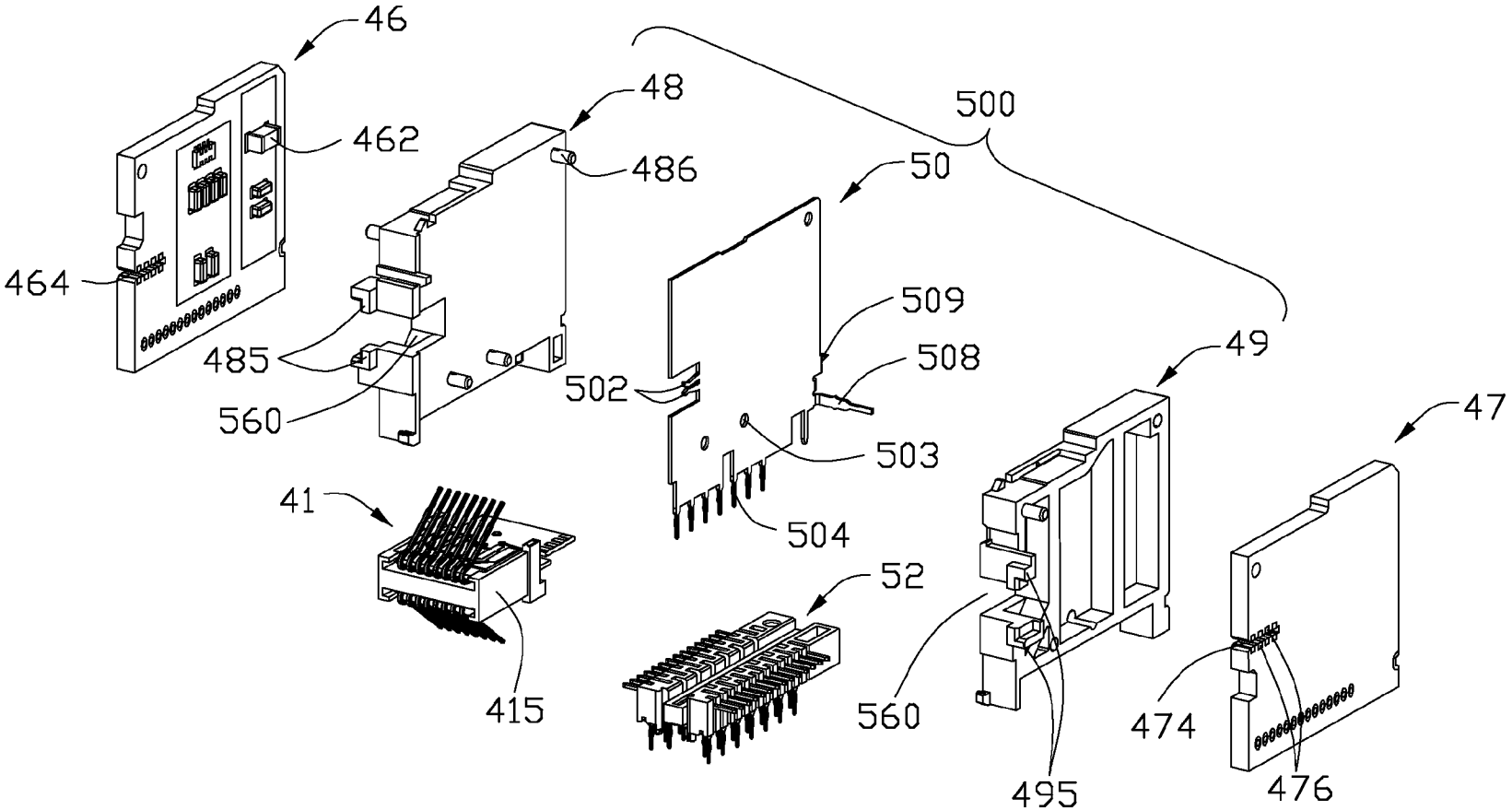
FIG. 4 is a partly exploded view of the contact module shown in FIG. 2.

Referring to FIGS. 2-4, the modular jack 100 further comprises an insulating housing 200, two contact subassemblies, and three shield modules 54. The contact subassembly further comprises two contact modules 400 and a bottom printed circuit board 401. Each contact module 400 comprises a center bracket 500, a transferring module 52, a left printed circuit board 46, a right printed circuit board 47, and a mating module 41.

Figure 5:
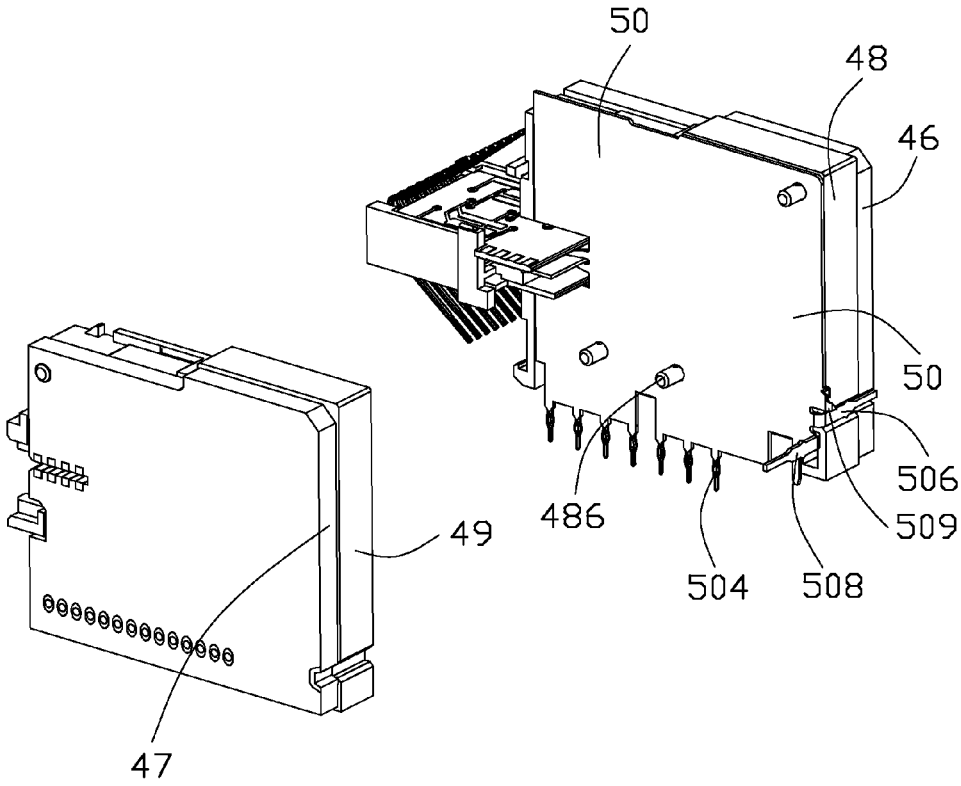
FIG. 5 is another partly exploded view of the contact module shown in FIG. 2.
Figure 6:
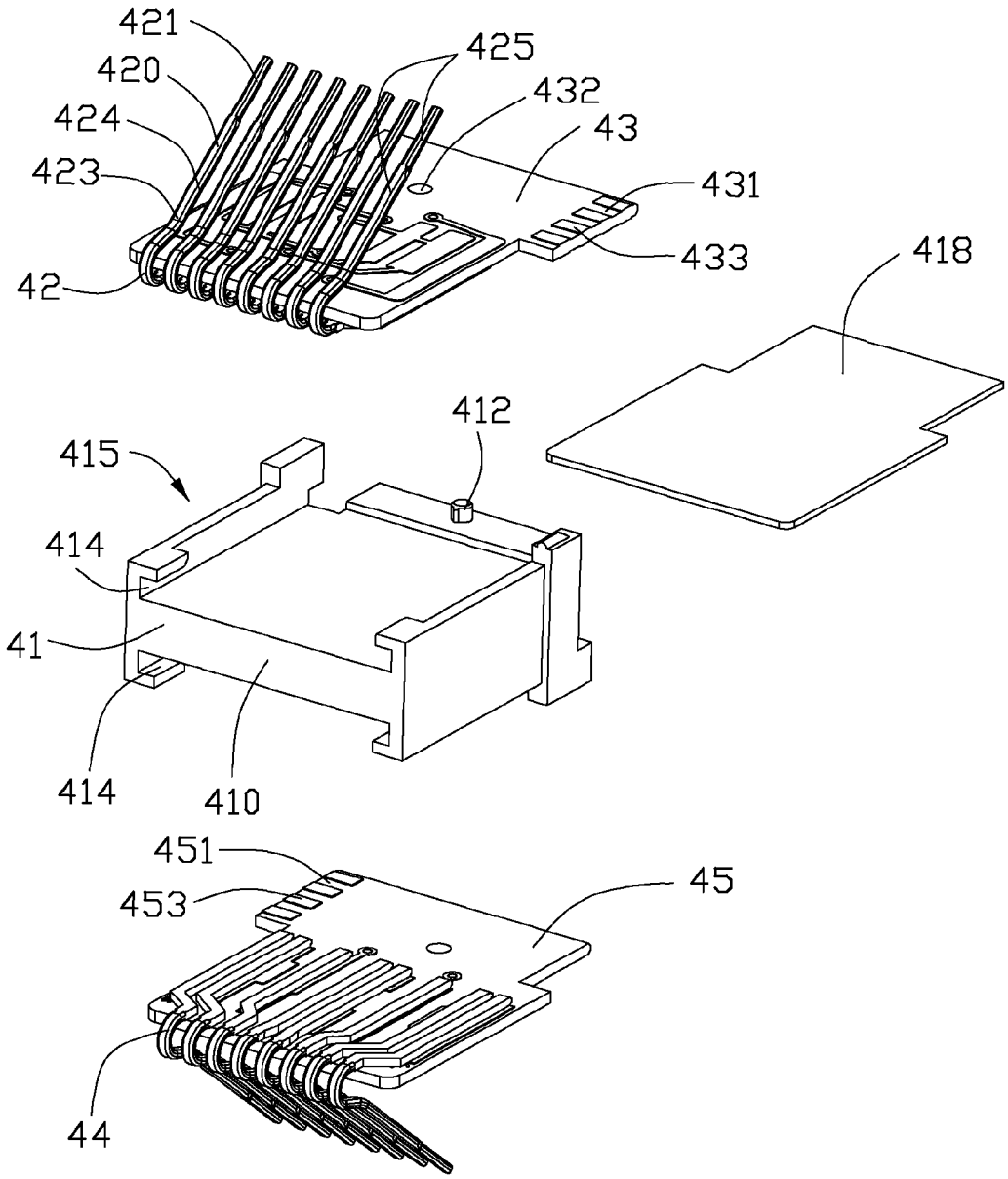
FIG. 6 is a partly exploded view of the mating contact module shown in FIG. 4.
Figure 7:
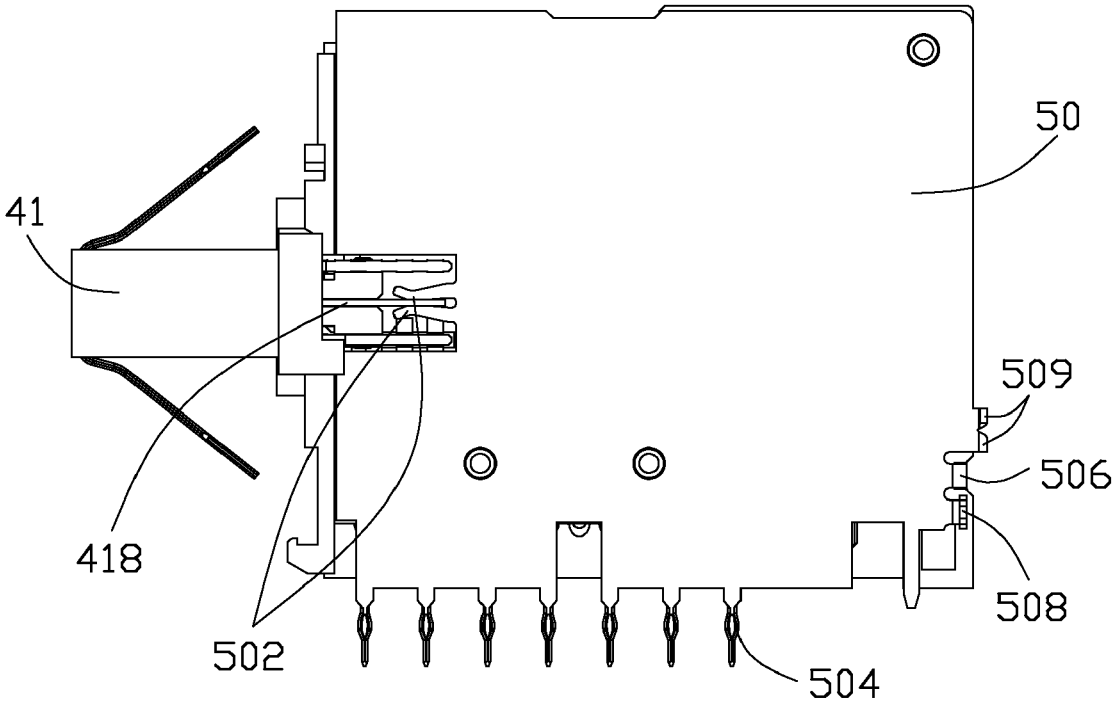
FIG. 7 is a side view of the contact module shown in FIG. 4, with part of components removed therefrom.

Referring to FIGS. 4-6, the mating module 41 comprises an upper set of mating contacts 42, a lower set of mating contacts 44, an upper PCB 43 bearing the upper set of mating contacts 42, a lower PCB 45 bearing the lower set of mating contacts 44, a front plastic body 415 bearing and separating the upper PCB 43 and the lower PCB 45, and a horizontal shield plate 418 forwardly inserted into a slot defined in the front plastic body 415 between the upper PCB 43 and the lower PCB 45. The upper PCB 43 and the lower PCB 45 are designed with circuits for balancing crosstalk between signal channels in the same port.

The front plastic body 415 is unitarily injection molded with a horizontal board 410. The horizontal board 410 has opposite top face and bottom face. The front plastic body 415 forms two upper guide slots 414 laterally opening face to face and an upper post 412 on the top face, and two lower guide slots 414 laterally opening face to face and a lower post 412 on the bottom face. When the upper and the lower circuit boards 43, 45 are assembled to the front plastic body 415, the circuit board 43, 45 are obliquely sliding onto the top and the bottom face under the guide of the guide slots 414 and then positioned by the post 412.

Referring to FIGS. 4-5 and 7-8, the center bracket 500 includes a vertical shield plate 50, a left plastic body 48 and a right plastic body 49 sandwich the vertical shield plate 50. The left plastic body 48 has three fastening posts 486 and the right plastic body 49 and the vertical shield plate 50 define three holes 503 for holding the fastening posts 486. The vertical shield plate 50 forms a pair of spring arms 502 extending forwardly. The spring arms 502 clip the horizontal shield plate 418. The vertical shield plate 50 further forms a plurality of grounding tails 504 for connecting the horizontal mother PCB 120, a left arm 506 connecting the left PCB 46 and a right arm 506 connecting the right PCB 47. The vertical shield plate 50 forms a pair of project tips 509 extending rearward through the rear outer shell 128 and then are riveted oppositely laterally for fixing the rear outer shell 128. The center bracket 500 has a front slot 560 receiving the mating module 41 therein. The front slot 560 has a pair of side walls (not labeled). The side walls have protrusions 485, 495 in front of the left PCB 46 and the right PCB 47. The protrusions 485, 495 mate with the mating module 41.

The vertical shield plate 50 has a marginal edge being scaled as possible so that the crosstalk is better shielded between the upper ports 204 and the lower ports 204. In the present embodiment, the marginal edge extends beyond the marginal edges of the left PCB 46 and the right PCB 47 in all directions. The vertical shield plate 50 has an upper edge 501 extending along upwardly beyond a top face of the contact module 400 and reaching the outer shell 126, 128. The housing 200 defines a top slot 201 to receive the upper edge 501 of the vertical shield plate 50.

The left PCB 46 and the right PCB 47 sandwich opposite sides of the center bracket 500. The left PCB 46 and the right PCB 47 have interior faces facing to each other and a plurality of electronic components mounted thereon. The left plastic body 48 defines cavities receiving the electronic components on the left PCB 46. The left PCB 46 defines a lower slot 464 opening forwardly and receiving a left edge 451 of the lower PCB 45. A plurality of conductive pads 453 are disposed on opposite surface of the lower PCB 45 and lined along the left edge 451. A corresponding number of conductive pads 466 are disposed along opposite sides of the lower slot 464 on an exterior face of the left PCB 46. A number of connecting conductors 468 electrically connect the conductive pads 453 of the lower PCB 45 to the conductive pads 466 of the left PCB 46. The right plastic body 49 defines cavities receiving the electronic components on the right PCB 47. The right PCB 47 defines an upper slot 474 opening forwardly and receiving a right edge 431 of the upper PCB 43. A plurality of conductive pads 433 are disposed on opposite surface of the lower PCB 43 and lined along the left edge 431. A corresponding number of conductive pads 476 are disposed along opposite sides of the upper slot 474 on an exterior face of the right PCB 47. A number of connecting conductors 478 electrically connect the conductive pads 433 of the upper PCB 43 to the conductive pads 476 of the right PCB 47.

It is noted that as an alternative embodiment of the present invention, the upper PCB 45 and the left PCB 46 are redesigned to be electrically connected, and the lower PCB 43 and the right PCB 47 are redesigned to be electrically connected.

Figure 8:
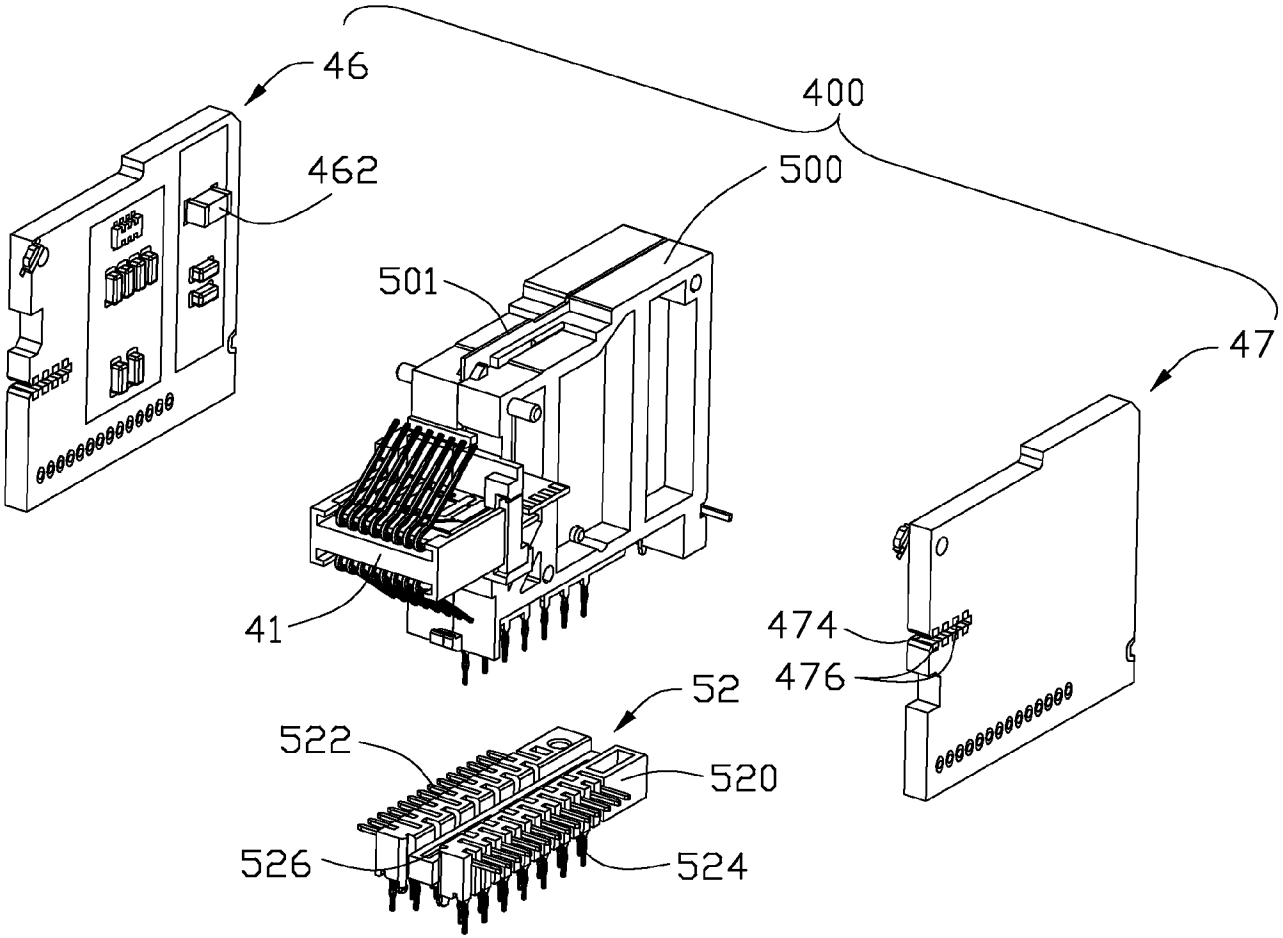
FIG. 8 is still another partly exploded view of the contact module shown in FIG. 2.

Referring to FIG. 8, the transferring module 52 comprises a plurality of left transferring contacts 522 electrically connecting the left PCB 46 to the horizontal mother PCB 120, a plurality of right transferring contacts 524 electrically connecting the right PCB 47 to the horizontal mother PCB 120, and a bottom plastic body 520 fixing the left transferring contacts 522 and the right transferring contacts 524. The bottom plastic body 520 defines a slot 526 between the left transferring contacts 522 and the right transferring contacts 524. The shield plate 50 extends downwardly through the slot 526 and the ground tails 504 continue extending there from.

Figure 9:
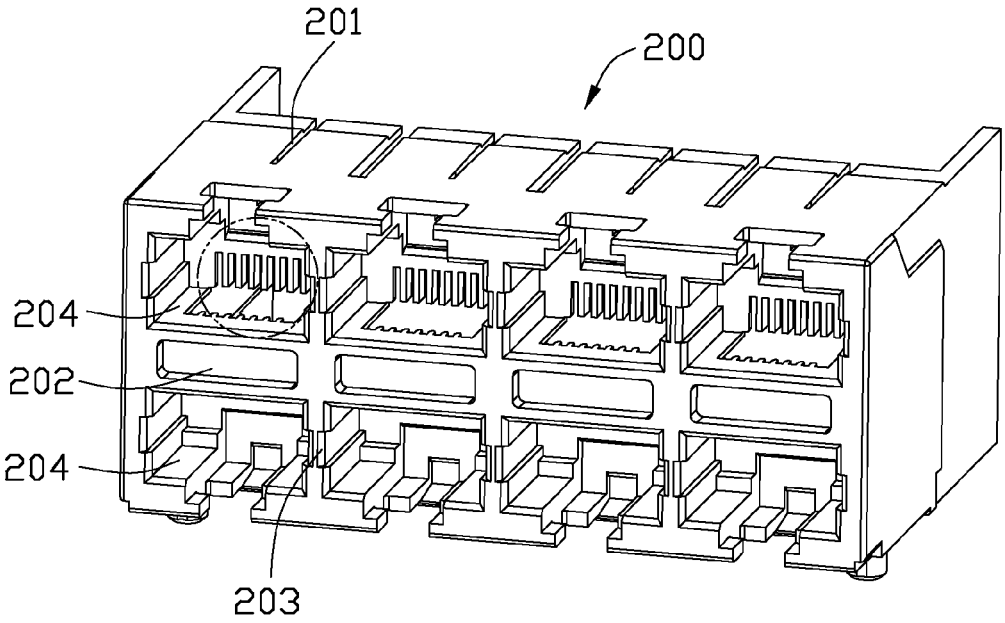
FIG. 9 is a perspective view of the housing shown in FIG. 2.
Figure 10:
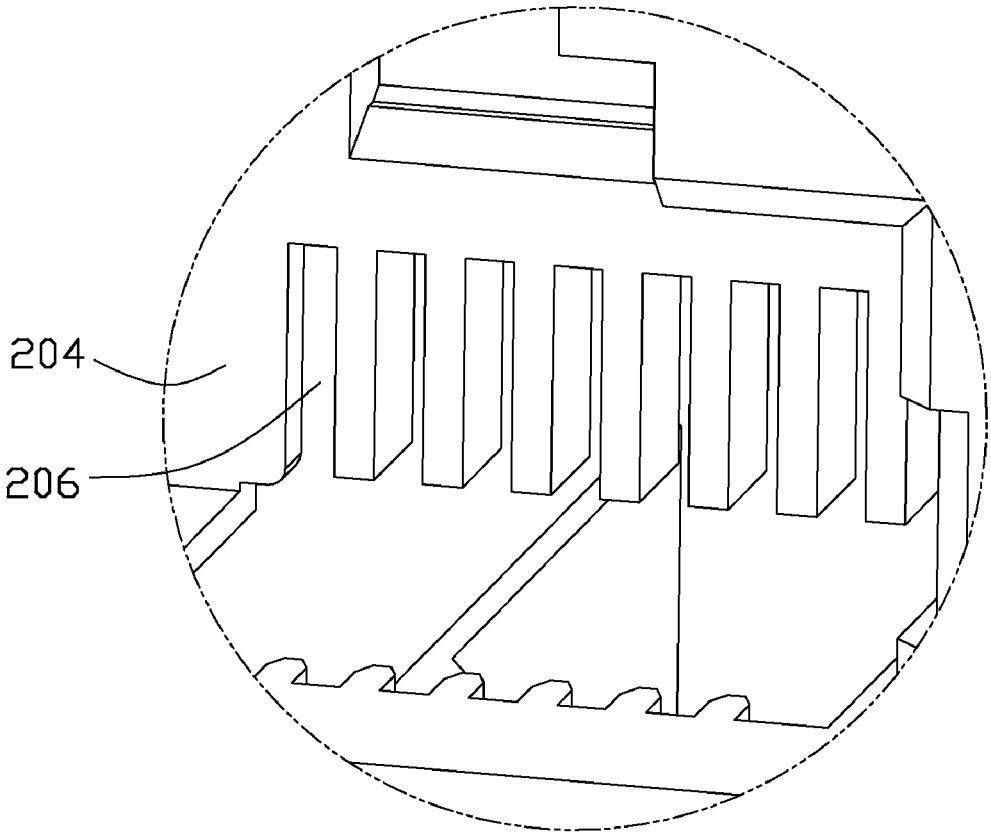
FIG. 10 is a scaled view of a circled portion shown in FIG. 9.
Figure 11:
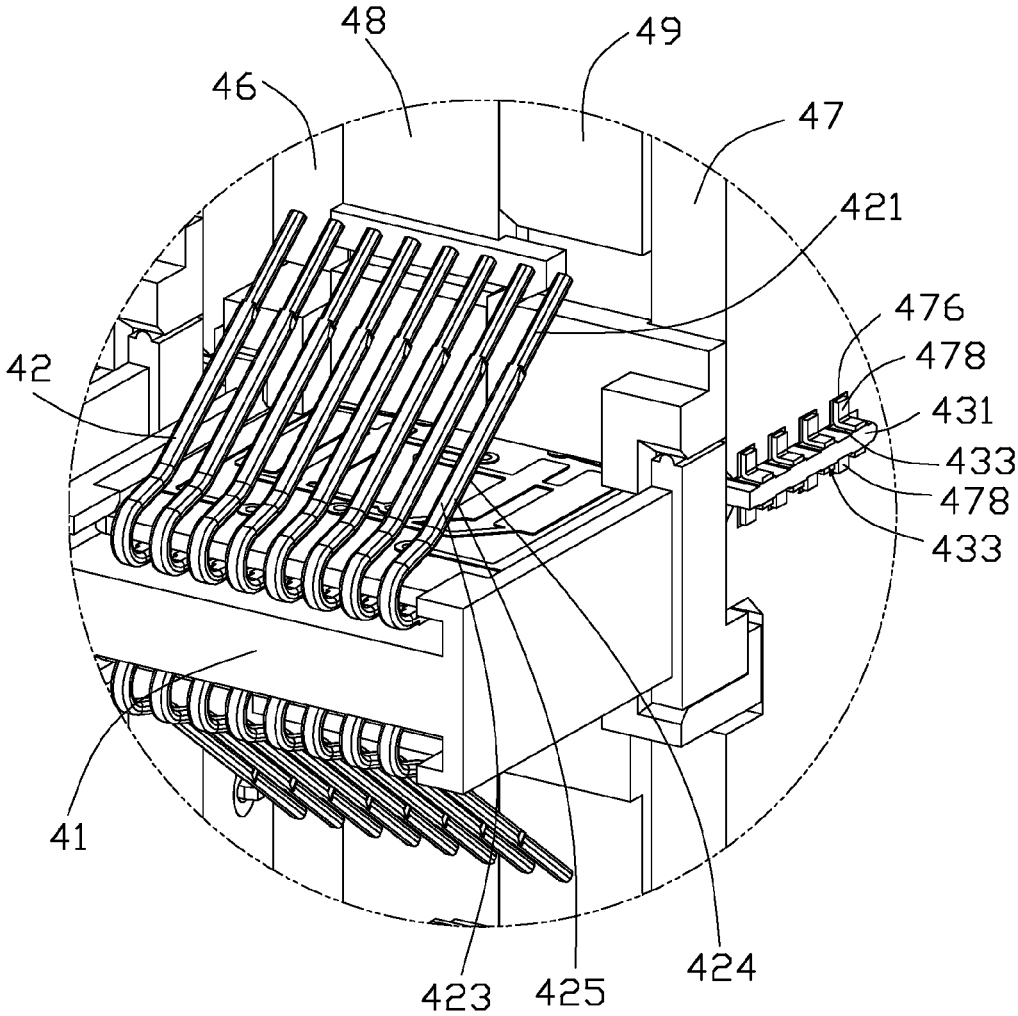
FIG. 11 is a scaled view of a circled portion shown in FIG. 2.

Referring to FIGS. 9-11, the insulating housing 200 defines 2×4 cavities 204 to form the 2×4 ports of the modular jack 100. The upper row of cavities 204 and the lower row of cavities 204 are separated by a horizontal wall 202. Any adjacent two columns ports are separated by a vertical wall 203. The insulating housing 200 forms eight slots 206 behind each of the cavities 204. The mating contacts 42, 44 are fixed to the horizontal wall 202. Each of the mating contacts 42, 44 comprises a contacting arm 420 and a tapered free end 421. The free ends 421 are received in respective slots 206. The mating contacts 42, 44 are formed and punched from a sheet material. Each of the mating contacts 42, 44 has two smooth surfaces 423 and two punched surfaces 424. Each of the mating contacts 42, 44 forms two round front corners 425 connecting a front smooth surface 423 and two punched surfaces 424, so that when the contact module 400 are inserted into the insulating housing 200, scratch to the housing 200 and the chance of damage to the mating contacts 42, 44 is greatly decreased.

Figure 12:
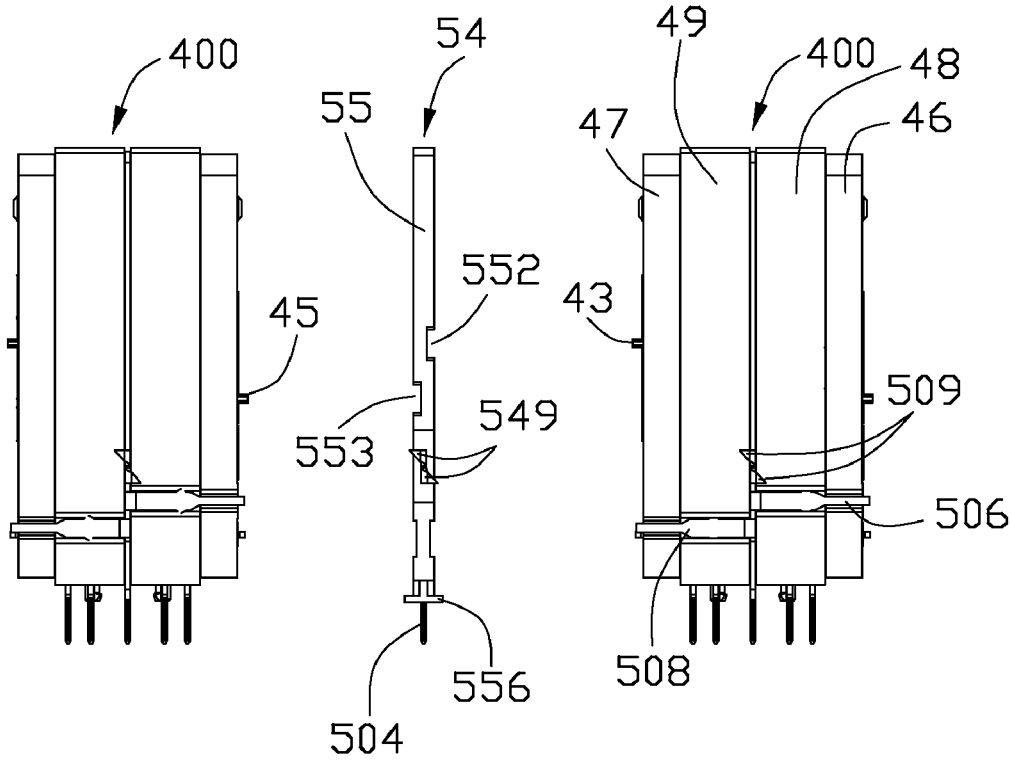
FIG. 12 is a back view of two contact modules and a shield module shown in FIG. 2, with each aligned separated position in a horizontal direction.
Figure 13:
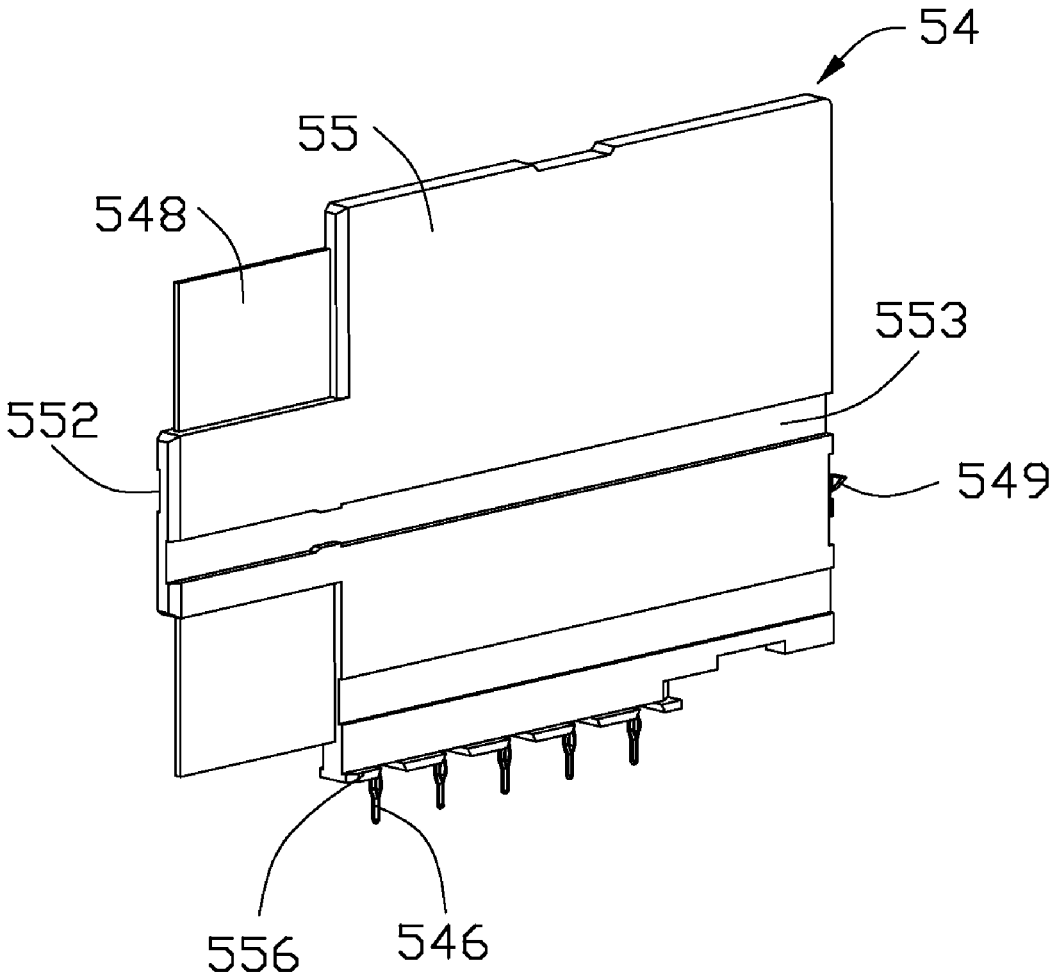
FIG. 13 is a perspective view of the shield module shown in FIG. 12.
Figure 14:
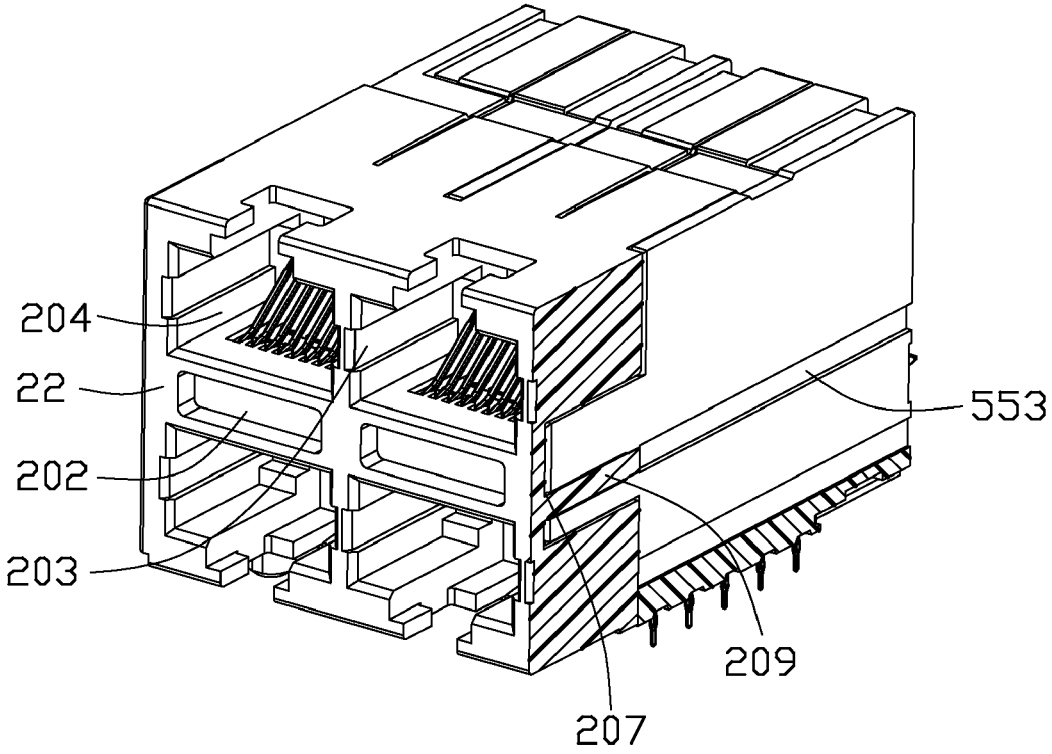
FIG. 14 is a cross-section view of the modular jack shown in FIG. 1, with the outer shell and the gasket removed.

Referring to FIGS. 12-14, each of the three shield modules 54 is disposed between two adjacent contact modules 400. The shield module 54 comprises a vertical shield 548 and a plastic body 55 over molding the vertical shield 548. The vertical shield 548 extends forwardly beyond the upper mating contacts 43 and the lower mating contacts 45, so that a more complete electrical shielding is formed between adjacent contact modules 400. The vertical shield 548 forms a plurality of ground tails 546 for electrically connecting the horizontal mother PCB 120.

The plastic body 55 defines a left slot 552 and a right slot 553 extending along a front-to-rear direction on opposite side. The left slot 552 mates a rib (not shown) of the housing and receives the right edge 431 of the upper PCB 43. The right slot 553 mates a rib 207 of the housing and receives the left edge 451 of the lower PCB 45. The shield plate 548 is bent according to the shape of the left slot 552 and the right slot 553, so that the plastic body 55 could be easier for injection molding. The plastic body 55 further forms two ribs 556 extending along the front-to-rear direction and oppositely protruding below the contact modules 400, which helps to fix the contact modules 400 and provide a press force when the modular jack 100 is mounted onto the PCB 120.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular jack adapted to be mounted onto a horizontal mother printed circuit board (PCB), comprising:

a housing defining an upper row of ports and a lower row of ports vertically stacked in columns; and a plurality of contact modules each comprising:

a first vertical PCB and a second vertical PCB extending along a front-to-rear direction;

a vertical shield plate disposed between the first vertical PCB and the second vertical PCB;

a mating module having an upper set of mating contacts electrically connecting one port in the upper row to the first vertical PCB and a lower set of mating contacts electrically connecting a lower port stacked in the same column to the second vertical PCB; and a horizontal shield plate disposed between the upper set of mating contacts and the lower set of mating contacts and physically connecting the vertical shield plate.

2. The modular jack according to claim 1, wherein the contact module further comprises a bracket supporting the first vertical PCB and the second vertical PCB and encapsulating a main part of the vertical shield plate.

3. The modular jack according to claim 2, wherein the bracket has a first plastic body and a second plastic body sandwiching opposite side of the vertical shield plate.

4. The modular jack according to claim 1, wherein the contact module has a top face, the vertical shield plate having an upper edge extending upwardly beyond the top face.

5. The modular jack according to claim 4, wherein the housing defines a top slot and the upper edge of the vertical shield plate is received in the top slot.

6. A modular jack adapted to be mounted onto a horizontal mother PCB, comprising:

a housing defining an upper row of ports and a lower row of ports vertically stacked in columns; and a plurality of contact modules each comprising:

a bracket having a vertical shield plate extending along a front-to- rear direction, a first plastic body and a second plastic body on opposite sides of the vertical shield plate;

a first vertical PCB and a second vertical PCB being arranged on opposite sides of the bracket and parallel to the vertical shield plate; and a mating module having an upper set of mating contacts electrically connecting one port in the upper row to the first vertical PCB and a lower set of mating contacts electrically connecting a lower port stacked in the same column to the second vertical PCB.

7. The modular jack according to claim 6, wherein the contact module has a top face and the vertical shield plate extends to said top face.

8. The modular jack according to claim 6, wherein the contact module has a transferring module electrically connecting the first vertical PCB and the second vertical PCB to the horizontal mother PCB, the transferring module defining a slot, the vertical shield plate having a bottom edge extending downwardly through the transferring module.

9. The modular jack according to claim 8, wherein a plurality of ground tails continually extend from the bottom edge of the vertical shield plate.

10. The modular jack according to claim 6, wherein the mating module has an upper horizontal PCB bearing the upper set of mating contacts and a lower horizontal PCB bearing the lower set of mating contacts.

11. The modular jack according to claim 10, wherein the mating module has a front plastic body supporting the upper horizontal PCB and the lower horizontal PCB.

12. A modular jack comprising:

a housing defining plural pairs of upper and lower ports;

a plurality of contact modules disposed in the housing, each of said contact modules corresponding to one corresponding pair of upper and lower ports, and including a bracket sandwiched by a pair of vertical PCBs (printed circuit board) and sandwiching a center vertical shielding plate, and a transferring module located below the bracket and including a plurality of contacts electrically and mechanically connected to bottom portions of the vertical PCBs, and further including an opening to allow a grounding leg of the center vertical shielding plate to extend therethrough downwardly; wherein each of said contact modules further includes a mating module with terminals thereon to electrically connect to the corresponding vertical PCBs.

13. The modular jack as claimed in claim 12, wherein the shielding plate defines grounding arms respectively mechanically and electrically connected to the corresponding vertical PCBs.

14. The modular jack as claimed in claim 12, wherein the mating module electrically connects to the corresponding vertical PCBs via a pair of horizontal PCBs.

15. The modular jack as claimed in claim 14, wherein a horizontal shielding plate is located between said pair of horizontal PCBs and electrically and mechanically connected to the shielding plate.

16. The modular jack as claimed in claim 14, wherein coupling between the horizontal PCB and the vertical PCB is made via a slot and edge structure.

17. The modular jack as claimed in claim 14, wherein said mating module further includes a front plastic body to separate the pair of horizontal PCBs.

18. The modular jack as claimed in claim 14, wherein the center vertical shielding plate defines a cutout in which the pair of horizontal PCBs and the horizontal shielding plate are received.

19. The modular jack as claimed in claim 14, wherein said pair of horizontal PCBs and said pair of vertical PCBs are coupled in a one by one condition.

20. The modular jack as claimed in claim 14, wherein said pair of horizontal PCBs are at upper and lower levels corresponding to the upper and lower ports, and configured to be transversely offset from each other for complying and coupling with the corresponding vertical PCBs, respectively.

* * * * *